United States Patent [19]

Grunden et al.

[11] 4,415,328

[45] Nov. 15, 1983

[54] FUEL AND IGNITION CONTROL

[75] Inventors: Michael T. Grunden; William J. Roberts, both of Toledo, Ohio

[73] Assignee: Allied Corporation, Morristown, N.J.

[21] Appl. No.: 306,568

[22] Filed: Sep. 28, 1981

[51] Int. Cl.[3] ..... F23C 11/04

[52] U.S. Cl. ..... 431/1; 431/27; 431/31; 60/39.76

[58] Field of Search ..... 431/1, 27, 31; 60/247, 60/39.76, 39.77; 122/24

[56] References Cited

U.S. PATENT DOCUMENTS

| | | | |
|---|---|---|---|
| 4,145,179 | 3/1979 | Tanaka et al. | 431/29 |
| 4,192,641 | 3/1980 | Nakagawa et al. | 431/31 X |
| 4,309,977 | 1/1982 | Kitchen | 431/1 X |

FOREIGN PATENT DOCUMENTS

| | | | |
|---|---|---|---|
| 52-51120 | 4/1977 | Japan | 431/31 |

*Primary Examiner*—James C. Yeung
*Assistant Examiner*—Randall L. Green
*Attorney, Agent, or Firm*—James P. DeClercq

[57] ABSTRACT

A fuel and ignition control for a pulse combustion furnace includes both analog and digital timing means for fail safe operation, fuel valve control means which depend on proper cyclic operation for proper function, and flame detection means which are fail safe due to the necessity of its components providing a critical phase shift angle. The fuel control valve means includes energy storage means which is stepwise depleted to positively limit the time of valve energization in the absence of detection of flame, and is also disabled after a predetermined time by the digital timing means.

3 Claims, 5 Drawing Figures

FUEL AND IGNITION CONTROL

BACKGROUND OF THE INVENTION

The invention is in the field of ignition systems for fluid fuels such as gaseous and liquid fuels. In particular, the invention is an ignition system adapted to ignite gaseous fuel in furnaces that require either a pre-ignition purge or multiple ignition attempts.

The preferred embodiment of the instant invention is directed to a direct spark ignition system for pulse combustion furnaces. A pulse combustion furnace includes a combustion chamber having separate valved entrances for gaseous fuel and combustion air, and operates in the same fashion as a pulse-combustion jet engine, such as a "buzz bomb". Upon ignition of the fuel-air mixture, a positive pressure in the chamber is created, closing the inlet valves. Flow of combustion products through an exhaust pipe then creates a negative pressure in the chamber, drawing in additional fuel and air. This negative pressure also momentarily reverses the flow of departing combustion products, and hot combustion products igniting the fresh fuel-air mixture. Due to the nature of such a system, ignition may be difficult. A combustible mixture of fuel and air must exist within the spark path of the ignition means, or ignition fails, since there is no continuous flow of the fuel-air mixture once it enters the chamber. If ignition is unsuccessful, admitting additional fuel and air may change the mixture ratio to a noncombustible ratio, and may also establish a combustible and explosive mixture ratio in the exhaust pipe, with possible consequent damage. Therefore, the chamber and exhaust pipe are purged, by a forced draft of air, before and after ignition attempts.

Fuel and ignition controls for such furnaces, which accomplish this function, are known. One such prior control system utilizes a mechanical pressure switch to sense combustion chamber pressure as indicative of ignition, has a conventional oil furnace ignition transformer in an effort to provide high-energy ignition impulses for dependable ignition, and uses a motor-driven mechanical cam timer for controlling the fuel valve, the oil furnace ignition circuit, and a purge fan. Another known circuit utilizes discrete components, analogue in nature, and four relays. As will be apparent, such systems, having mechanical components, are prone to failure, and provide numerous modes of failure which cannot be rendered totally fail-safe, since the possibility exists that a fuel control valve may be maintained in an energized condition, when ignition has not been obtained.

The instant invention overcomes these and other deficiencies of the prior art.

SUMMARY OF THE INVENTION

The instant invention provides a fuel and ignition control circuit particularly adapted for a pulse combustion furnace, although containing features which may advantageously be used in other types of fuel and ignition systems.

The disclosed embodiment of the invention may use either the same electrode used for providing sparks and for detecting ignition, or may use a separate electrode for detecting ignition. Ignition may be detected between individual sparks, or, in the preferred embodiment, to ensure dependable detection of ignition, the fuel control valve is maintained in an energized condition for a short period of time after sparking has ceased.

As will be apparent, the disclosed circuit may be easily modified to provide dependable inter-spark sensing.

The illustrated preferred embodiment of the invention includes both analog and digital circuitry, the digital circuitry acting to provide appropriate de-energization should the analog portion become defective, and the digital portion provides fail-safe operation should the analog portion become defective. In addition, the fuel valve control portion of the disclosed embodiment of the invention provides a novel trail-for-ignition fuel control valve timing means, in addition to means for preventing the fuel control valve from being operated in the case of a failure of a control component.

Thus, it is a first object of the invention to provide a fuel and ignition control having an advantageous combination of analog and digital components, the digital timing components providing the required de-energization of portions of the illustrated embodiment of the invention should an unpredictable failure of a combination of components in the analog portion fail, the analog portion containing integral timing means for de-energizing during a trial for ignition independent of the digital timing means. It is an advantage of the invention that increased safety is provided. It is a feature of the invention that the fuel valve control means includes an integral timer operating from a fixed quantity of energy provided to energy storage means during an idle time for limiting the time of fuel valve operation in the absence of flame detection, and is operably connected to a digital timing means to both provide fail-safe operation and to limit the time the fuel control valve is energized should the energy storage means contain a larger than desired quantity of energy.

It is a further object of the invention to provide fuel valve control means having integral timing means including a first energy storage means containing a predetermined quantity of energy, and means for incrementally discharging the energy storage means, to provide a repeatable fuel valve operating time. It is a feature of the invention that the first energy storage means is discharged into a second energy storage means, and the energy transferred to the second energy storage means is dissipated. It is an advantage of the invention that failure of either the first or second energy storage means, or of the means for discharging will result in fail-safe operation.

Additional objects and advantages will become apparent from the detailed description which follows.

BRIEF DESCRIPTION OF THE DRAWINGS

The drawings illustrate a preferred embodiment of the invention, illustrating numerous features which may be advantageously used in other embodiments of fuel and ignition control systems.

DESCRIPTION OF THE PREFERRED EMBODIMENT

Figure 1:
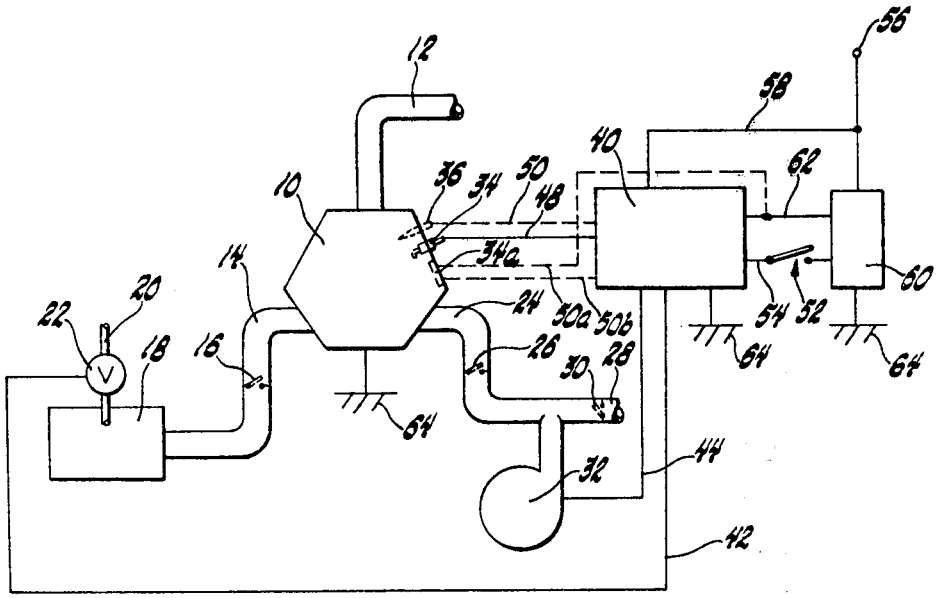
FIG. 1 is an illustration of a pulse combustion unit provided with a fuel and combustion control according to the invention.

As illustrated in FIG. 1, the preferred embodiment of the invention is used in conjunction with a pulse-combustion furnace, having a combustion chamber 10, an exhaust pipe 12, a fuel inlet pipe 14 controlled by flapper valve 16, and connected to an expansion chamber 18. Fuel from fuel supply pipe 20 is admitted into chamber 18 by fuel control valve 22. Air inlet pipe 24 is controlled by flapper valve 26, and may receive combustion air from an inlet here shown as inlet 28 controlled by flapper valve 30, or from purge fan or blower 32. Combustion chamber 10 is provided with a spark electrode or probe 34, which may also be used to detect the presence of flame, and may be in the form of a conventional spark plug. Alternately, an alternate flame detection probe 36, shown in broken lines, may be employed. Also, a conventional pressure switch for detecting flame by the presence of combustion pressure in combustion chamber 10 may be used. As shown in broken lines, a pressure switch 34*a* may be supplied with power through a line 50*a*, and provide a signal to fuel and ignition control 40 through line 50*b*.

The preferred embodiment of the invention, fuel and ignition control 40, controls fuel control valve 22 through line 42, controls fan or blower 32 through line 44, and either provides ignition sparks and senses the presence of flame through line 48, or senses the presence of flame through line 50, shown as a broken line connected to alternate flame detector probe 36, and provide ignition spark impulses to spark electrode 34 through line 48. Fuel and ignition control 40 receives a thermostat command signal from thermostat switch 52 on line 54. Although, as will be apparent, a single supply voltage may be used, the preferred embodiment of the invention is supplied with a nominal 120 volts AC from input 56 through line 58, and also with 24 volts AC from thermostat transformer 60 through line 62. This voltage is also provided to thermostat switch 52. A common ground 64, or other suitable return means, is provided for combustion chamber 10, fuel and ignition control 40, and thermostat transformer 60. As set forth in greater detail below, upon closing of thermostat switch 52, purge blower 32 is operated for a predetermined period of time, closing flapper valve 30 and forcing purge air into combustion chamber 10 and exhaust pipe 12. Then, fuel control valve 22 is actuated, allowing fuel to pass into expansion chamber 18, through valve 16 and pipe 14 to chamber 10, where it is mixed with the air in chamber 10, and ignited by spark probe 34. If ignition occurs, combustion will close flapper valve 16 and 26, and force combustion products through exhaust pipe 12. Cooling at the end of the combustion results in a decrease in chamber pressure, drawing fuel and air through flapper valve 16 and 26, respectively. The temporarily reduced pressure in chamber 10 momentarily reverses the flow in exhaust pipe 12, and brings some of the hot exhaust gases in exhaust pipe 12 back into chamber 10, to light the new fuel-air mixture. This sequence continues as long as valve 22 is actuated. If ignition does not occur, valve 22 is de-activated, and purge fan or blower 32 is activated to clear chamber 10 of the unburned mixture in preparation for another attempt at achieving ignition. This sequence may repeat for a predetermined number of times in an attempt to achieve ignition.

Figure 2:
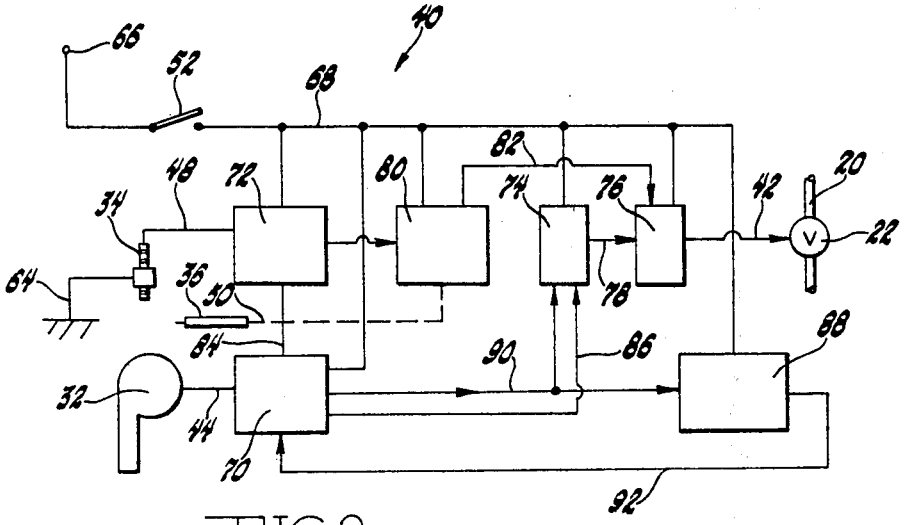
FIG. 2 is a symbolic diagram of a fuel and ignition control according to the preferred embodiment of the invention.

FIG. 2 shows a symbolic or block diagram of the preferred embodiment of the invention, shown for simplicity of illustration as including only a single voltage supply input 66 supplying power to power line 68 through thermostat switch 52. In the illustrated application of the preferred embodiment of the invention, digital timing means 70 first operates purge fan or blower 32, and then operates spark generating means 72 and starts analog fuel valve control timer 74, which in turn energizes fuel valve control means 76 through line 78, which in turn energizes valve 22 through line 42. If ignition is obtained, flame detection means 80 provides a signal on line 82 to fuel valve control means 76 to maintain fuel control valve 22 in an energized condition. Digital timing means 70 then removes the control signal from line 84, and spark generating means 72 ceases to operate.

If ignition is not successfully obtained on this trial for ignition, and flame is not detected before or after digital timing means 70 stops the operation of spark generating means 72, fuel valve 22 will be de-energized either by its internal timer or by a control signal appearing on line 86 from digital timing means 70. Digital counting means 88 is adapted to permit only a predetermined number of trials for ignition before causing the fuel and ignition control according to the invention to cease operation. As illustrated, digital counting means 88 is responsive to a signal appearing on line 90 which begins the operation of fuel valve control timer 74, and provides a reset signal upon line 92 to allow digital timing means 70 to begin another trial for ignition, until a predetermined number of trials have been attempted.

Figure 3:
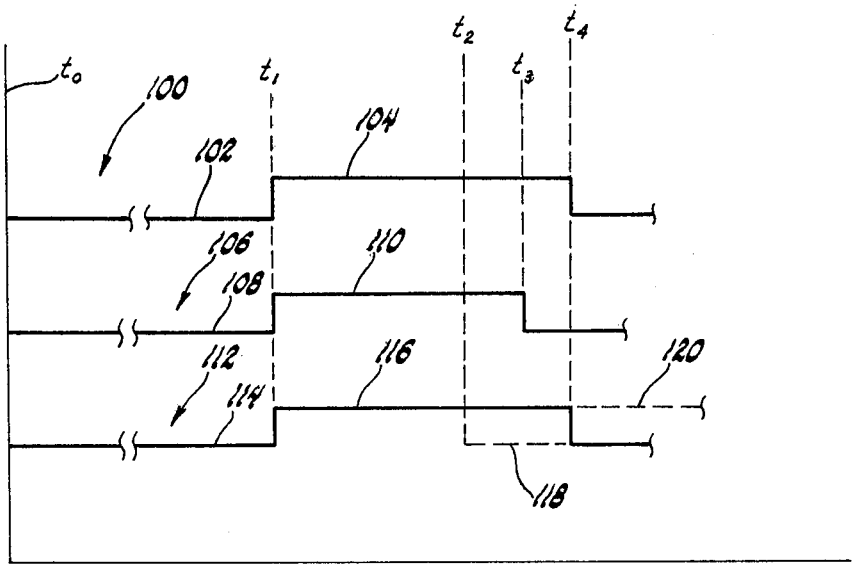
FIG. 3 is a timing diagram of a single trial for ignition utilizing the preferred embodiment of the invention to control fuel and ignition.

FIG. 3 shows a timing diagram of a single ignition attempt. It should be noted that the timing shown in FIG. 3 assumes that the preferred embodiment of the invention has been previously used, since, on initial connection, a single purge cycle, without activation of the spark generating means or fuel valve control means, occurs. Timing line 100 indicates the basic timing of the preferred embodiment of the invention, and shows a de-energized state 102 and an energized state 104. Spark means timing line 106 is indicative of the timing of spark generating means 72, and has a de-energized state 108 and an energized state 110. Fuel valve timing line 112 indicates the timing of fuel control valve 22, and shows a de-energized state 114 and an energized state 116. At time $t_0$, it is assumed that thermostat switch 52 is closed, and digital timing means 70 becomes operative. At this time purge blower or fan 32 is actuated, and maintained in an actuated state unless combustion is sensed. At time $t_1$, which in the preferred embodiment is approximately 34 seconds after time $t_0$, spark generating means 72 and fuel valve control means 76 are actuated by digital timing means 70. Time $t_2$ is indicative of the normal time that fuel control valve 22 will be de-energized by the analog fuel valve control timer 74 in normal operation. It should be noted that fuel valve control timer 74 may, in the preferred embodiment of the invention, maintain fuel control valve 22 in an energized condition for a slightly longer time if, as will be more fully described below, more than one purge cycle, the time from time $t_0$ to time $t_1$, has been sequentially performed. This may occur immediately after initial electrical connection of the invention, or due to abnormal operation of thermostat switch 52. In this event, fuel valve timing line 112 would be at energized state 116 beyond time $t_2$. At time grated circuit IC4, acting as the output of digital counting means 88, shown in FIG. 2, is initially at a low voltage, so that input 340 of integrated circuit IC8 is at a low voltage. Integrated circuit IC12, an AND gate, has an input 328 connected to output 326 of integrated circuit IC4, which is initially at a low voltage, forcing output 330 of integrated circuit IC12 and input 332 of integrated circuit IC8 to a low voltage. Thus, output 182 of integrated circuit IC8 is initially low. Output 182 is connected to resistor R10 at junction 184. Resistor R10 is electrically connected between junction 184 and base lead 186 of transistor Q1. Transistor Q1 has an emitter 188 and a collector 190 connected to ground line 146. This low voltage allows current to flow from line 152, through a relay coil RY2 connected between line 152 and emitter 188, to collector 190 and ground 146. This closes contacts K2 connected between voltage supply input 166 and line 44, energizing purge fan or blower 32.

As illustrated, operation of the purge fan or blower 32 continues until output 182 of integrated circuit IC8 assumes a high voltage state. This will first occur approximately 34 seconds after power is initially applied.

When thermostat switch 52 is subsequently closed, the purge fan or blower 32 is again energized for a time of approximately 34 seconds, as will be explained in greater detail below. After this 34 second time, output 192 of integrated circuit IC1 assumes a high voltage state, which appears on line 194.

At this time, input 196 of integrated circuit IC9, connected to line 194 assumes a high voltage state. A transistor Q2 has an emitter terminal 198 connected to line 146, and a collector 200 connected to line 152 through a resistor R11. Line 142, carrying an alternating voltage, is connected to base lead 202 of transistor Q2 through the series combination of diode D5 and resistor R12. Thus, a half wave rectified signal appears at base lead 202, causing transistor Q2 to become alternately conductive and nonconductive, causing collector 200 to alternate between high and low voltages. Collector 200 is connected to input 204 of integrated circuit IC9, causing output 206 of integrated circuit IC9 to deliver a square wave voltage. This square wave voltage is delivered to gate lead 208 of threshold device SCR1 through resistor R13, connected between output 206 and gate lead 208. Gate lead 208 is connected to ground line 146 through pull down resistor R14 connected between gate lead 208 and ground line 146. A resistor R15 and diode D6, connected in series between line 142 and junction 210, provide a half wave rectified voltage, to charge capacitor C13, connected between junction 210 and ground line 146. Capacitor C13 discharges through resistor R16, connected between junction 210 and ground line 146. The values of resistor R15 and capacitor C13 are chosen to allow capacitor C13 to charge during a single positive excursion of the alternating voltage appearing on line 142. The threshold of base lead 202 of transistor Q2 and of input 204 of integrated circuit IC9 produce a signal at base lead 208 of threshold device SCR1 that is shifted with respect to the voltage appearing at junction 210, causing threshold device SCR1 to become conductive between anode 212 and cathode 214 near the end of a positive half cycle of the voltage appearing on line 142, allowing capacitor C13 to discharge through primary winding 211 of transformer T1, connected between junction 210 and anode 212. This induces a voltage impulse in secondary winding 218, to cause a spark to appear at spark electrode or probe 34 at a rate of 60 Hz. If desired, since flame sensing between ignition sparks using a single spark and flame sensing probe may be further improved under some conditions if the ignition sparks are spaced further apart, by providing a conventional AND gate interposed between input 196 and line 194, having a first input connected to 194 and a second input connected to an appropriate output of integrated IC1, such as to output 220, to provide a binary submultiple of the line supply frequency of 60 Hz, thus extending the time between sparks.

When line 194 assumed a high voltage state after the thirty-four second purge cycle, input 222 of integrated circuit IC10, connected as an inverter, becomes a high voltage, causing output 224 to become a low voltage, and forcing transformer Q3 to become nonconductive, blocking the flow of current from its collector 228 to its emitter 230, connected to ground line 146. Collector 228 is connected to gate lead 232 of threshold device SCR3, allowing threshold device SCR3 to function.

Half wave rectified power from line 142 passes through resistor R18 and diode D7, a series combination connected to line 142 and to junction 234. This power flows through resistor R19, connected to junction 234, and to gate lead 232, triggering threshold device SCR3. A resistor R20, connected between gate lead 232 and ground line 146 proportions the voltage at gate lead 232. During idle time, including the 34 second purge cycle time, half wave rectified current flows through resistor R21 and diode D8, a series combination connected to line 142, to junction 236, and charges capacitor C6, connected to junction 236, through resistor R22, having a first terminal 238 connected to a terminal of capacitor C6 and to cathode 240 of SCR4. The opposite terminal of resistor R22 is connected to ground line 146.

When SCR3 is made conductive, current flows from its anode 242 to its cathode 244, connected to ground line 146. Thus, current flows from capacitor C6 into capacitor C5, connected between junction 236 and anode 242. The amount of energy transferred from capacitor C6 to capacitor C5 is predetermined by the ratio of their capacitances, capacitor C5 being smaller than capacitor C6. This renders threshold device SCR4 conductive, since cathode 240 is forced to become negative with respect to gate lead 246 of threshold device SCR4, which is coupled to ground line 146 by resistor R23. This has two effects. First, it should be noted that capacitor C7, having a first terminal 248 connected to junction 234 and to anode 250 of threshold device SCR4, and a terminal 252 connected to ground line 146 through resistor R24, is charged through resistor R18 and D7. The value of resistor R18 is chosen to allow capacitor C7 to charge quickly with respect to the frequency of the applied alternating voltage. When threshold device SCR4 becomes conductive, current flows from terminal 248 to ground line 146, and from ground line 146 to terminal 252 through capacitor C8 and diode D1. Diode D1 has a cathode 254 connected to terminal 252 and an anode 256. The parallel combination of capacitor C8 and relay coil RY1 is connected between anode 256 and ground line 146. Thus, capacitor C8 is charged, and subsequently discharges to relay coil RY1, actuating fuel control valve 22. As will be apparent, these components are critical to the operation of fuel control valve 22, so that a failure of any of these components will de-energize fuel control valve 22, in a fail-safe manner. Thus, capacitor C7 and C8 must both be operational. Diode D1 must be operational, since a failure $t_3$, as indicated by spark means timing line 106, spark generating means 72 assumes its de-energized state, under control of digital timing means 70. In the preferred embodiment of the invention, time $t_3$ occurs approximately 6.4 seconds after time $t_1$. At time $t_4$, trial for ignition timing line 100 goes to its de-energized state 102 under command of digital timing means 70. Also, fuel control valve 22 is de-energized by digital timing means 70 if analog timing means 74, either for the reason described above or for any other reason, has not previously put fuel control valve 22 into a de-energized state.

Portions 118 and 120 of fuel valve timing line 112 indicate the timing which occurs when fuel valve control timer 74 de-energizes fuel control valve 22, and the timing when flame detection means 80 detects combustion in chamber 10. Thus, as shown by portion 118, fuel control valve 22 may be de-energized previous to time $t_4$, or, as shown by portion 120, it may remain energized indefinitely, until thermostat switch 52 is opened.

Figure 4:
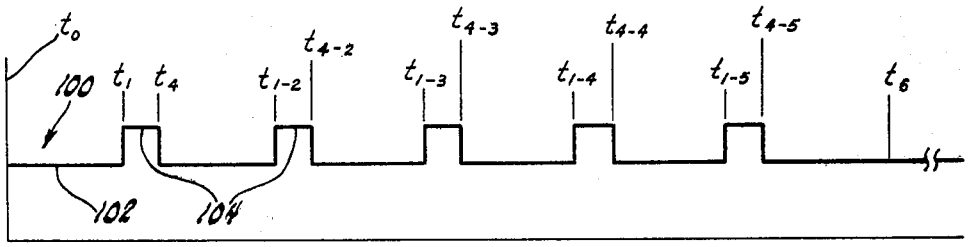
FIG. 4 illustrates the timing obtained by using the preferred embodiment of the invention for fuel and ignition control in the absence of ignition.

FIG. 4 shows trial for ignition timing line 100 in greater detail, and illustrates the operation of digital timing means 70 and digital counting means 88, which permits digital timing means 70 to call for a predetermined number of trials for ignition. In FIG. 4, from time $t_0$ to time $t_6$, the purge fan or blower 32 will be actuated unless ignition is obtained and flame is detected. The detection of flame deactuates blower 32. From time $t_1$ to $t_4$, the sequence shown in greater detail in FIG. 3 is performed. Assuming ignition has not been attained, from time $t_4$ to time $t_{1-2}$, purge fan or blower 32 will be actuated, and, from time $t_{1-2}$ to time $t_{4-2}$, the sequence shown in FIG. 3 will again occur. Again, assuming failure to achieve combustion, purge fan or blower 32 will continue to be actuated. The trial for ignition sequence occurs three more times, for a total of five times, each trial for ignition being preceded and followed by a purge cycle caused by operation of purge fan or blower 32. At time $t_6$, which, in the preferred embodiment of the invention is 246.5 seconds, fuel and ignition control 70 and purge fan or blower 32 are disabled, and remain disabled until either power is removed and reapplied or until thermostat switch 52 is opened and reclosed.

Figure 5:
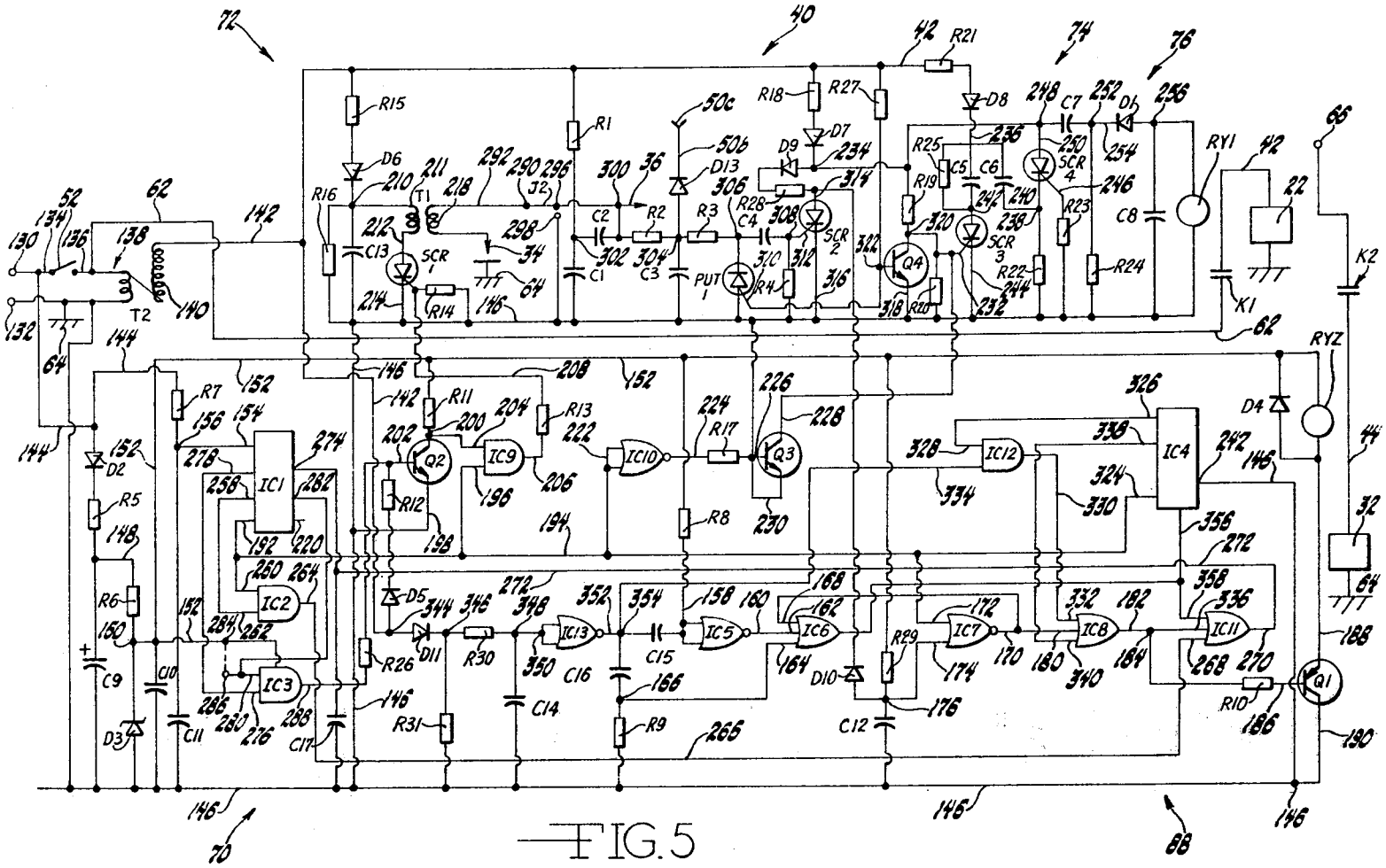
FIG. 5 is a schematic diagram of a fuel and ignition control according to the preferred embodiment of the invention.

FIG. 5 is a circuit diagram of the preferred embodiment of the invention. As illustrated, integrated circuits IC1, IC2 and IC3 are the major components of the digital timing means 70 of the invention, integrated circuit IC1 being a 12 bit binary counter known as a type 4040, and available from Motorola Semiconductor Products, Incorporated of Austin, Tex., U.S.A., as part number MC14040B. Integrated circuits IC2, IC3, IC9, and IC12 are AND gates and integrated circuits IC5, IC7, IC10, and IC13 are NOR gates and integrated circuits IC6, IC8 and IC11 are OR gates. Integrated circuit IC4 is the major component of the digital counting means according to the invention, and, as illustrated, is a five stage decade counter with integral code converter known as a type 4017 and available from Motorola Semiconductor Products, Incorporated as a part number MC14017B. Threshold device SCR1 and transformer T1 are the principal active components of spark generating means 72 according to the invention. Resistors R1, R2, R3 and R4, and capacitors C1, C2, C3 and C4, and programmable unijunction transistor PUT1 form flame detection means according to the invention. Threshold device shown as silicon controlled rectifier SCR3, with capacitors C5 and C6, form fuel valve control timer 74, while threshold devices shown as silicon controlled rectifier SCR4, together with threshold device SCR2 and capacitors C7 and C8, diode D1 and relay RY1 having contacts K1 are included in fuel valve control means 76 according to the invention.

For convenience, the schematic diagram of FIG. 5 will be described in the context of an operating cycle.

The preferred embodiment of the invention utilizes three different voltage levels. Input terminals 130 and 132 are connected to a conventional thermostat transformer such as thermostat transformer 60, which typically provides a 24 volt, 60 Hz supply. Input terminal 132 is connected to ground 64. Input terminal 130 is connected to terminal 134 of thermostat switch 52. When thermostat switch 52 is activated, current flows through thermostat switch 52 to terminal 136, which is connected to primary winding 138 of transformer T2. This causes the appearance of a voltage of approximately 120 volts, 60 Hz on secondary 140 of transformer T2. This voltage appears on line 142, connected to secondary 140.

The voltage appearing at input terminal 130 appears on line 144. As illustrated, diode D2, resistor R5 and capacitor C9 are connected in series arrangement between line 144 and a ground line 146, connected to ground 64. A resistor R6 and Zener diode D3 are connected between the junction 148 between resistor R5 and capacitor C9 and ground line 146, the cathode of diode D3 being connected to junction 150 between diode D3 and resistor R6. As will be apparent, this provides a rectified and regulated voltage at junction 150, which is subsequently filtered by capacitor C10, connected between junction 150 and ground line 146. The actual supply connections for each integrated circuit have been omitted for clarity when possible. As will be apparent, each integrated circuit must have a terminal connected to junction 150, connected to line 152, and to ground line 146. A resistor R7 and capacitor C11 are also connected between line 144 and ground line 146, for the purpose of providing a 60 Hz clock signal to integrated circuit IC1, a clock terminal 154 of integrated circuit IC1 being connected to junction 156 between resistor R7 and capacitor C11.

When power is initially applied to the illustrated circuit, purge fan or blower 32 will be actuated for approximately 34 seconds, according to the preferred embodiment of the invention, and no further outputs will occur, it being assumed that thermostat switch 52 remains open. As illustrated, a pull up resistor R8, connected between line 152 and input 158 of integrated circuit IC5, shown as a NOR gate connected as an inverter. This causes a low voltage to appear at output 160 of integrated circuit IC5. This low voltage is connected to input 162 of integrated circuit IC6, shown as a three input OR gate. Integrated circuit IC6 has a second input 164, connected to ground line 146 through resistor R9 at junction 166. A third input 168 of integrated circuit IC6 is connected to output 170 of integrated circuit IC7. Integrated circuit IC7, shown as a two input NOR gate, has inputs 172 and 174. Input 174 is connected to the regulated line 152 through resistor R29 at junction 176, so it will be at a high voltage state. As will be further explained below, input 172 is connected to an output of integrated circuit IC1, and is low at this time. Therefore, low voltage appears at output 170, input 168 and input 180 of integrated circuit IC8, shown as a three input OR gate. Integrated circuit IC8 also includes input 340, connected to output 338 of integrated circuit IC4, and input 322, connected to output 330 of integrated circuit IC12. Output 338 of intewould either result in failure to charge capacitor C8, or provision of an alternate discharge path through resistor R24. Threshold device SCR4 must remain functional, because, as will be apparent, its cyclical conductivity and nonconductivity are necessary to transfer the energy in capacitor C7 to capacitor C8. Even in the case of multiple component failures, resistor R18 will limit the current through relay coil RY1, to prevent its energization.

When threshold device SCR4 became conductive, in response to threshold device SCR3 being conductive, the voltage present at junction 234 approaches the voltage present at ground line 146, and, through resistors R19 and R20, shunts the voltage at gate lead 232 towards the voltage on ground line 146, rendering threshold device SCR3 nonconductive, which in turns renders threshold device SCR4 nonconductive, since energy is no longer being drawn from capacitor C6. The energy which has been transferred to capacitor C5 is then discharged through resistor R25, connected to opposite terminals of capacitor C5. Thus, capacitor C6 contains sufficient energy for a predetermined number of pulse-like discharges of a predetermined magnitude and, considering the cyclical nature of the voltage applied to line 142, a predetermined fuel control valve operating time. As will be apparent, when the charge upon capacitor C7 is depleted in subsequent cycles, current may no longer flow through capacitor C6 to trigger threshold device SCR4, disabling fuel control valve 22. These components are also critical to the operation of the illustrated embodiment of the invention, since capacitor C5 and C6 must both be functional, and threshold device SCR3 must become alternately conductive and nonconductive, so that the failure of threshold device SCR3 either shorted or open would disable fuel control valve 22.

In the illustrated embodiment of the invention, the charge on capacitor C6 provides a fuel control valve energization time of about six seconds. However, since idle time varies, the charge upon capacitor C6 also varies, and in normal operation a time slightly in excess of six seconds may be obtained if multiple purge cycles are performed before a trial for ignition cycle. In any event, this internal analog timer provides a fail-safe mechanism, in de-energizing fuel control valve 22 after a relatively short time, in the absence of combustion.

Approximately eight seconds after the end of the 34 second purge cycle which caused line 194 to assume a high voltage state, output 258 of integrated circuit IC1 assumes a positive value. Integrated circuit IC2 has a first input 260 connected to terminal 192 and line 134, and a second input 262 connected to output 258. Thus, output 264 of integrated circuit AND gate IC2 assumes a high voltage state, as does line 266 connected to output 264. Line 266 is connected to a first input 268 of an integrated circuit OR gate IC11, forcing its output 270 to assume a high voltage state. Output 270 is connected through line 272 to a reset input 274 of integrated circuit IC1. This causes output 192 and line 194 to assume a low voltage, removing the input from input 196 of integrated circuit IC9, disabling threshold device SCR1 and the spark generating means, and removing the input from input 222 of integrated circuit IC10, disabling threshold device SCR3, de-energizing fuel control valve 22 if it is still energized for any reason, in the absence of detection of combustion.

Although not absolutely necessary, it is sometimes desirable to have an interval of time during which combustion or flame can be detected, free of disturbance by ignition sparks. To this end, integrated circuit IC3, an AND gate, is provided with a first input 276, connected to an output 278 of integrated circuit IC1 that assumes a high voltage state at four second intervals, assuming a 60 Hz input to clock input 154 and a second input 280. As shown, input 280 may be connected either to an output 282 of integrated circuit IC1 which assumes a high voltage state at two second intervals, or to the constant high voltage provided by line 152 by providing the jumper shown as jumper J1 between connection point 284 on line 152 and connection point 286 of input 280. Thus, output 288 of integrated circuit IC3 may assume a high voltage level either four or six seconds after the 34 second purge cycle, and, acting through resistor R26, connected between output 288 and base lead 202 of transistor Q2, apply this high voltage level to base lead 202, rendering transistor Q2 conductive, causing a low voltage to appear at collector 200, disabling threshold device SCR1 prior to the time fuel control valve 22 is disabled, so that combustion, if present, may be reliably sensed without regard to the positioning of flame sensing means within combustion chamber 10.

Combustion is detected by so-called flame rectification, wherein the flame acts as an inefficient diode having an anode connected to spark electrode or probe 34, or to a separate flame detection probe, and a cathode connected to ground 34, thus providing a negative voltage at the flame or conduction detecting probe. This phenomenon appears to be based on plasma current flow, and the difference in relative sizes between the burner and the sparking electrode, current flowing from the small probe to the large burner easier than current flow from the large burner to the small probe. The illustrated embodiment of the invention provides for an auxiliary or alternate flame detection probe 36, if desired, a jumper J2 being placed between a connection point 290 attached to the end 292 of secondary winding 218 of transformer T1 distal from spark electrode or probe 34 and connection point 296, if integral flame detection is desired, or to connection point 298, connected to ground line 146, if an alternate flame detection probe 36 is desired. In either event, the voltage appearing at junction 300, from either probe 36 or connection point 296 will be a small negative voltage to which will be added the phase shifted AC voltage appearing at junction 302, between the series combination of resistor R1 and capacitor C1 connected between lines 142 and 146. This voltage flows through capacitor C2, connected between junctions 300 and 302. The series combination of resistor R2 and capacitor C3, connected between junction 300 and line 146, provides a further phase shifted signal at junction 304, which is coupled to junction 306 through resistor R3, connected between junctions 304 and 306. The voltage appearing at junction 306 begins to charge capacitor C4 through resistor R4, connected in series between junction 306 and ground 146, and having a junction 308 therebetween.

If flame detection based on the presence of combustion pressure in chamber 22 is desired, instead of direct flame sensing based on the electrical characteristics of a flame, a conventional pressure switch, preferably a conventional diaphragm-type pressure switch such as 34*a*, shown in FIG. 1, may be connected to fuel and ignition control 40 instead of the phase shift network described above. In an embodiment of the invention, a pressure switch has an input terminal connected to a first line such as line 50*a*, shown in FIG. 1, connected to a source of 24 Vac power, such as to input terminal 130 of FIG. 5 or line 62 of FIG. 2, and an output terminal connected to an output line such as line 50*b*, shown in FIG. 1, and shown in broken lines in FIG. 5 with a terminal 50*c*. The addition of diode D13, with its anode connected to junction 304 and its cathode connected to line 50*b* allows the deletion of resistors R1 and R2, capacitors C1 and C2 and alternate flame detection probe 36, and associated wiring. In this case, connection points 290 and 298 would be connected together.

In the preferred embodiment of the invention, the voltage appearing across capacitor C4 is a negative-biased alternating current signal shifted approximately 170° from the signal appearing on line 142. Thus, threshold device SCR2 may only be triggered near the zero crossing of a voltage cycle as appearing on line 142. Thus, as will become apparent, the values of these components are also properly critical, since too little phase shift will fail to trigger threshold device SCR2, resulting in fail-safe de-energization of fuel control valve 22.

If flame is present, a negative voltage will build across capacitor C4 at junction 306, until programmable unijunction PUT1, shown connected between junction 306 and ground line 146 is triggered. The threshold of programmable unijunction transistor PUT1 is set by resistor R27, connected between line 142 and gate 310 of programmable unijunction transistor PUT1. Programmable unijunction transistor PUT1 becoming conductive, current flows from capacitor C4, through programmable unijunction transistor PUT1 to ground line 146, and from ground line 146 through resistor R4 to junction 308, connected to gate 312 of threshold device SCR2. This provides a positive voltage at gate 312, rendering threshold device SCR2 conductive between its anode 314 and cathode 316, connected to ground line 146. In this event, current flows through the series combination of diode D9 and resistor R28 connected between junction 234 and anode 314 to ground line 146, discharging capacitor C7 to ground line 146, and from ground line 146 into capacitor C8, bypassing threshold device SCR4 to maintain fuel control valve 22 in an energized state.

Therefore, if combustion is detected, flame detection means 80 maintains fuel control valve 22 in an energized condition, regardless of subsequent actions of the remainder of the illustrated invention. However, if combustion is not attained, the fuel and ignition control according to the preferred embodiment of the invention will perform another attempt.

It should be noted at this point that a transistor Q4 is provided, having an emitter 318 connected to ground line 146, a collector connected to junction 320 between resistor R19 and resistor R20 and a base connected to gate 310 of programmable unijunction transistor PUT1. This transistor provides protective clamping for programmable unijunction transistor PUT1, and also provides a cyclical signal to gate lead 232 of SCR3 to complete the discharge of timing capacitor C6 through capacitor C5.

When line 194 fell to a low voltage state when integrated circuit IC1 was reset eight seconds after the end of the thirty-four second purge cycle, this action provided a clock pulse to clock input 324 of integrated circuit IC4 of digital counting means 88. A capacitor C12, which is charged through a resistor R29 connected to line 152, and discharged by a diode D10 connected to anode 314 of threshold device SCR2 if conduction is detected, provides a low voltage to input 174 of integrated circuit IC7 if flame is present, and a high voltage if it is not.

If flame is present, integrated circuit IC7, acting through integrated circuits IC8 and IC11, resets integrated circuit IC1 through line 272 and input 274. Also, integrated circuit IC7, acting through integrated circuit IC6, resets integrated circuit IC4 through reset input 356. Also, output 182 of integrated circuit IC8 will be at a high voltage state, which voltage will be applied to junction 184 and to transistor Q1, de-energizing purge blower or fan 32. If flame is not present, reset does not occur and integrated circuit IC1 may continue timing. Output 326 of integrated circuit IC4 assumes a high voltage state after a single purge cycle, this high voltage being applied to an input 328 of integrated circuit IC12, which has an output 330 connected to an input 332 of integrated circuit IC8. Integrated circuit IC12 has a second input 334 which, as will become apparent below, is at a high voltage state when thermostat switch 52 is open, and at a low voltage when the thermostat switch is closed. Thus prevents a trial for ignition following a purge cycle if the thermostat is open, by acting on integrated circuit IC8 to make its output 182 a high voltage, which acts on input 336 of integrated circuit IC11 to force its output 270 and reset line 272 into a high voltage state, resetting integrated circuit IC1.

If thermostat switch 52 is closed, this sequence of purge cycles and trials for ignition may continue for up to five trials for ignition, each followed by a purge cycle. The end of the final or sixth purge cycle, as detected by clock input 324, causes output 338 of integrated circuit IC4 to assume a high voltage state. This high voltage is applied to an input 340 of integrated circuit IC8 to cause its output 182 to become a high voltage, rendering transistor Q1 nonconductive as before, and placing a reset signal on reset line 272, resetting integrated circuit IC1 through input 274 and maintaining it in a reset state, until integrated circuit IC4 itself is reset. IC4 itself is enabled at all times, its input 242 being connected to ground line 146.

If thermostat switch 52 is closed, power will be applied to line 142, which is connected to junction 344, which joins the anode of diodes D5 and D11, power then flowing through diode D11 to junction 346, between resistors R30 and R31. Resistor R31 is connected between junction 346 and ground line 146, and resistor R30 is connected between junction 346 and junction 348. A capacitor C14 is connected between junction 348 and ground line 146, so that junction 348 remains at a low voltage level for a period of time following the closure of thermostat switch 52. Junction 348 is connected to input 350 of integrated circuit IC13, which is connected as an inverter having an output 352 connected to junction 354. Junction 354 is connected to input 344 of integrated circuit IC12, thus preventing output 330 of integrated circuit IC12 from assuming a high voltage state while thermostat switch 52 is closed. Also, a capacitor C15 is connected between junction 354 and input 158 of integrated circuit IC5, and a capacitor C16 is connected between junction 354 and junction 166. Thus, capacitors C15 and C16 are continuously charged from line 152 and resistors R8 and R9.

When junction 354 becomes a low voltage following closure of thermostat switch 52, capacitor C15 is discharged causing output 160 of integrated circuit IC5 to assume a high voltage state, and forcing output 178 of integrated circuit IC6 to a high voltage state, resetting integrated circuit IC4 through its reset input 356 connected to output 178, and forcing output 270 of integrated circuit IC11 to a high voltage state. This resets integrated circuit IC1 through input 358 of integrated circuit IC11, output 270 of integrated circuit IC11, line 172 and input 274. A capacitor C17 provides filtering of the reset signal applied to reset input 274 of integrated circuit IC1. Thus, a user may reset the fuel and ignition control according to the preferred embodiment of the invention following a predetermined number of unsuccesful trials for ignition, to cause it to perform additional attempts to obtain combustion. When the thermostat switch 52 is opened, either at the end of a normal heating cycle or manually, line 142 goes to a low voltage state, allowing input 350 of integrated circuit IC13 to assume a low voltage state, causing its output 352 to assume a high voltage state. This high voltage state, acting on the series combination of capacitor C16 and resistor R9, generates a pulse at junction 166. This pulse, applied to input 164 of integrated circuit IC6, and OR gate, causes a high pulse at its output 178, connected to reset input 356 of integrated circuit IC4, and to reset line 272, resetting integrated circuits IC1 and IC4, to provide a 34 second post purge cycle, to clear any remaining combustion gases from combustion chamber 10.

As will be apparent, numerous variations and modifications of the disclosed preferred embodiment of the invention are possible and may be easily made by one skilled in the art of electrical circuit design without departing from the spirit and scope of the invention.

We claim:

1. A fuel and ignition control for a fuel burner disposed in a combustion chamber for igniting fuel supplied to said fuel burner in response to a thermostat control signal to cause a flame, said fuel burner being operably connected to means for supplying a fluid fuel to said fuel burner, including:

probe means for supplying a spark for igniting said fuel and for detecting said flame;

spark generating means for supplying spark energy to said probe means;

valve means for stepwise controlling the flow of said fuel;

detector means responsive to said probe means for providing a first signal indicative of the presence of said flame;

said detector means including phase shift means for phase shifting said first signal slightly less than one hundred eighty electrical degrees, and first threshold means responsive to said phase-shifted first signal for providing a second signal indicative of the presence of said flame and for controlling said valve means;

first storage means for storing energy to control the operation of said valve means for a first predetermened time;

second storage means for storing energy to operate said valve means;

second threshold means for causing a third threshold means to become conductive to supply energy from said second storage means to said valve means, said second threshold means being responsive to said third threshold means for rendering said third threshold means nonconductive to pulsewise deplete said first storage means and to pulsewise provide energy from said second storage means to said valve means for said first predetermined time;

said first threshold means pulsewise intermittently providing energy from said second stoage means to said valve means when said flame is present;

purge means for purging said combustion chamber;

first digital timer means operatively coupled to said purge means for operating said purge means for at least a second predetermined time period, said first digital timer means being operatively connected to said spark generating means to permit said spark generating means to begin to supply said spark energy at a third predetermined time subsequent to said second predetermined time period, said first digital timer means being operably connected to said second threshold means to allow said second threshold means to cause said third threshold means to become conductive to operate said valve means during said third predetermined time, said first digital timer means further being operatively connected to said spark generating means to cause said spark generating means to stop supplying said spark energy at a fourth predetermined time, said first digital timer means being further operatively connected to said second threshold means to prevent said second threshold means from causing said third threshold means to become conductive to operate said fuel valve means at a fifth predetermined time, said fourth predetermined time and said fifth predetermined time being subsequent to said second predetermined time period;

first digital counting means operably connected to said first digital timer means for controlling said first digital timer to cause said first digital timer to operate said purge means, said spark generating means, and said second threshold means for a first predetermined number of repetitions;

whereby said ignition system, in response to said thermostat control signal repetitively sequentially purges said combustion chamber, and then operates said fuel valve means and said spark generating means for a predetermined number of repetitions unless the presence of said flame is sensed and thereafter maintains said fuel valve means in an energized condition.

2. A fuel and ignition control according to claim 1, wherein:

a single probe means is operably connected to said spark generating means and to said detector means, for supplying said spark and detecting said flame.

3. A fuel and ignition control according to claim 1, wherein:

said probe means includes a first probe means and a second probe means;

said first probe means is operably connected to said spark generating means for supplying said spark; and said second probe means is operably connected to said detector means for detecting said flame.

* * * * *